US007303376B2

(12) United States Patent
Liang

(10) Patent No.: US 7,303,376 B2
(45) Date of Patent: Dec. 4, 2007

(54) TURBINE AIRFOIL WITH OUTER WALL COOLING SYSTEM AND INNER MID-CHORD HOT GAS RECEIVING CAVITY

(75) Inventor: George Liang, Palm City, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 85 days.

(21) Appl. No.: 11/293,464

(22) Filed: Dec. 2, 2005

(65) Prior Publication Data

US 2007/0128031 A1 Jun. 7, 2007

(51) Int. Cl.
*F01D 5/18* (2006.01)

(52) U.S. Cl. ..... 416/96 R; 416/97 R; 416/233

(58) Field of Classification Search ..... 415/115, 415/177, 178; 416/96 R, 97 R, 232, 233
See application file for complete search history.

(56) References Cited

U.S. PATENT DOCUMENTS 4,474,532 A 10/1984 Pazder
4,712,979 A 12/1987 Finger
5,488,825 A 2/1996 Davis et al.
5,609,466 A 3/1997 North et al.
5,690,472 A * 11/1997 Lee ..... 416/97 R
5,702,232 A * 12/1997 Moore ..... 416/95
6,152,695 A 11/2000 Fukue et al.
6,386,827 B2 5/2002 Yu et al.
6,572,335 B2 6/2003 Kuwabara et al.
6,773,230 B2 * 8/2004 Bather et al. ..... 416/97 R
2004/0009066 A1 1/2004 Soechting et al.
2004/0076519 A1 4/2004 Halfmann et al.
2005/0042096 A1 2/2005 Hall et al.
2005/0095119 A1 5/2005 Liang

* cited by examiner

*Primary Examiner*—Ninh H. Nguyen

(57) ABSTRACT

A turbine airfoil usable in a turbine engine and having at least one cooling system. The cooling system may be positioned in an outer wall of the turbine airfoil, and the airfoil may include a hot gas receiving cavity positioned in a mid-chord region of the airfoil. The hot gas receiving cavity may have an opening in a tip of the airfoil to enable hot gases to circulate into the hot gas receiving cavity. In at least one embodiment, the cooling system in the outer wall and the hot gas receiving cavity may include a plurality of ribs. Cooling fluids may be passed through the cooling system in the outer wall, and hot combustion gases may be passed into the hot gas receiving cavity to moderate the temperature of the inner portions of the outer wall to reduce the temperature gradient in the outer wall.

20 Claims, 7 Drawing Sheets

TURBINE AIRFOIL WITH OUTER WALL COOLING SYSTEM AND INNER MID-CHORD HOT GAS RECEIVING CAVITY

FIELD OF THE INVENTION

This invention is directed generally to turbine airfoils, and more particularly to hollow turbine airfoils having cooling channels for passing fluids, such as air, to cool the airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine vane and blade assemblies to these high temperatures. As a result, turbine vanes and blades must be made of materials capable of withstanding such high temperatures. In addition, turbine vanes and blades often contain cooling systems for prolonging the life of the vanes and blades and reducing the likelihood of failure as a result of excessive temperatures.

Typically, turbine airfoils are formed from an elongated portion having a tip at one end and a root coupled to a platform at an opposite end of the airfoil. The root is configured to be coupled to a disc. The airfoil is ordinarily composed of a leading edge, a trailing edge, a suction side, and a pressure side. The inner aspects of most turbine airfoils typically contain an intricate maze of cooling circuits forming a cooling system. The cooling circuits in the airfoils receive air from the compressor of the turbine engine and pass the air through film cooling channels throughout the airfoil. The cooling circuits often include multiple flow paths that are designed to maintain all aspects of the turbine airfoil at a relatively uniform temperature. At least some of the air passing through these cooling circuits is exhausted through orifices in the leading edge, trailing edge, suction side, and pressure side of the airfoil.

Many conventional turbine airfoils have cooling channels positioned at the leading and trailing edges and the outer walls. The airfoils often have a mid-chord cooling channel that may have a serpentine configuration or other design. Often times, the cooling channel is pressurized with cooling fluids to provide adequate cooling fluids to all portions of the cooling channels forming the cooling system in the airfoil. The walls forming the pressurized mid-chord cooling channel often remain at temperatures much lower than portions of the airfoil in contact with hot combustion gases, thereby resulting in a large thermal gradient between these regions. The large thermal gradient often results in a reduced mechanical life cycle of airfoil components and poor thermal mechanical fatigue (TMF). Therefore, the inner cooling channel often negatively affects the life cycle of the airfoil. Thus, a need exists for a turbine airfoil having increased cooling efficiency for dissipating heat while reducing the thermal gradient between the cooling channels and the hot combustion gases.

SUMMARY OF THE INVENTION

This invention is directed to a turbine airfoil having a cooling system in inner aspects of the turbine airfoil for use in turbine engines. The cooling system may be configured such that adequate cooling occurs within an outer wall of the turbine airfoil by including one or more cooling cavities in the outer wall and configuring each outer cooling cavity based on local external heat loads and airfoil gas side pressure distribution in both chordwise and spanwise directions. The turbine airfoil may include a hot gas receiving cavity positioned in the mid-chord region of the turbine airfoil. The hot gas receiving cavity allows hot combustion gases to flow in central aspects of the turbine airfoil to heat inner walls of the airfoil forming the hot gas receiving cavity. By heating the inner walls, the thermal gradient in the materials forming the outer wall is minimized, thereby increasing the life of the airfoil.

The turbine airfoil may be formed by a generally elongated airfoil formed from an outer wall, a leading edge, a trailing edge, a pressure side, a suction side, a tip section at a first end, a root coupled to the airfoil at an end generally opposite to the first end for supporting the airfoil and for coupling the airfoil to a disc, and at least one outer cooling cavity in the outer wall forming a cooling system in the airfoil. The turbine airfoil may include at least one leading edge spanwise cooling channel extending from generally proximate the root toward the tip. The turbine airfoil may also include at least one trailing edge spanwise cooling channel extending from generally proximate the root toward the tip.

The at least one outer cooling cavity may extend generally spanwise from a location proximate to the root to a location proximate to the tip. The at least one cooling cavity in the outer wall may include at least one rib extending from a first inner surface forming the at least one cooling cavity and proximate to an outer surface of the airfoil to a second inner surface forming the at least one outer cooling cavity, opposite to the first inner surface, and proximate to a surface of the airfoil forming the hot gas receiving cavity. In at least one embodiment, the at least one cooling cavity in the outer wall may include a plurality of ribs forming rows in which the ribs may be offset or aligned chordwise from adjacent ribs in the at least one hot gas receiving cavity forming rows that extend chordwise.

The airfoil may also include at least one hot gas receiving cavity positioned mid-chord in the airfoil and having an inlet opening in the tip. The hot gas receiving cavity may extend from the tip to a location proximate to the root. The hot gas receiving cavity may include at least one rib extending from an inner surface of the outer wall of the pressure side to an inner surface of the outer wall of the suction side. In at least one embodiment, the hot gas receiving cavity may include a plurality of such ribs. The ribs may be positioned into rows extending chordwise, and the ribs within the rows may be aligned or offset in the chordwise direction relative to ribs in adjacent rows.

An advantage of this invention is that the high temperature gradient typically found within conventional airfoils having cooling cavities in the outer wall is greatly reduced in the airfoil of the instant invention due to the heating that occurs in the hot gas receiving cavity positioned in the mid-chord region of the airfoil. Introducing hot gases into the mid-chord region of the airfoil heats inner portions of the airfoil, thereby preventing the formation of extreme thermal gradients within the airfoil and increasing the life span of the airfoil.

Another advantage of this invention is that the hot gas receiving cavity creates improved TMF in the airfoil, thereby increasing the life cycle of the airfoil, as compared with conventional designs.

Yet another advantage of this invention is that the hot gas receiving cavity positioned in the central region of the airfoil eliminates the need to pressurize the airfoil mid-chord cavity. The lack of a mid-chord cooling cavity minimizes the pressure gradient between the hot gas receiving cavity and the outer wall cooling cavity, thereby increasing the efficiency of the turbine engine into which the airfoil is mounted.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
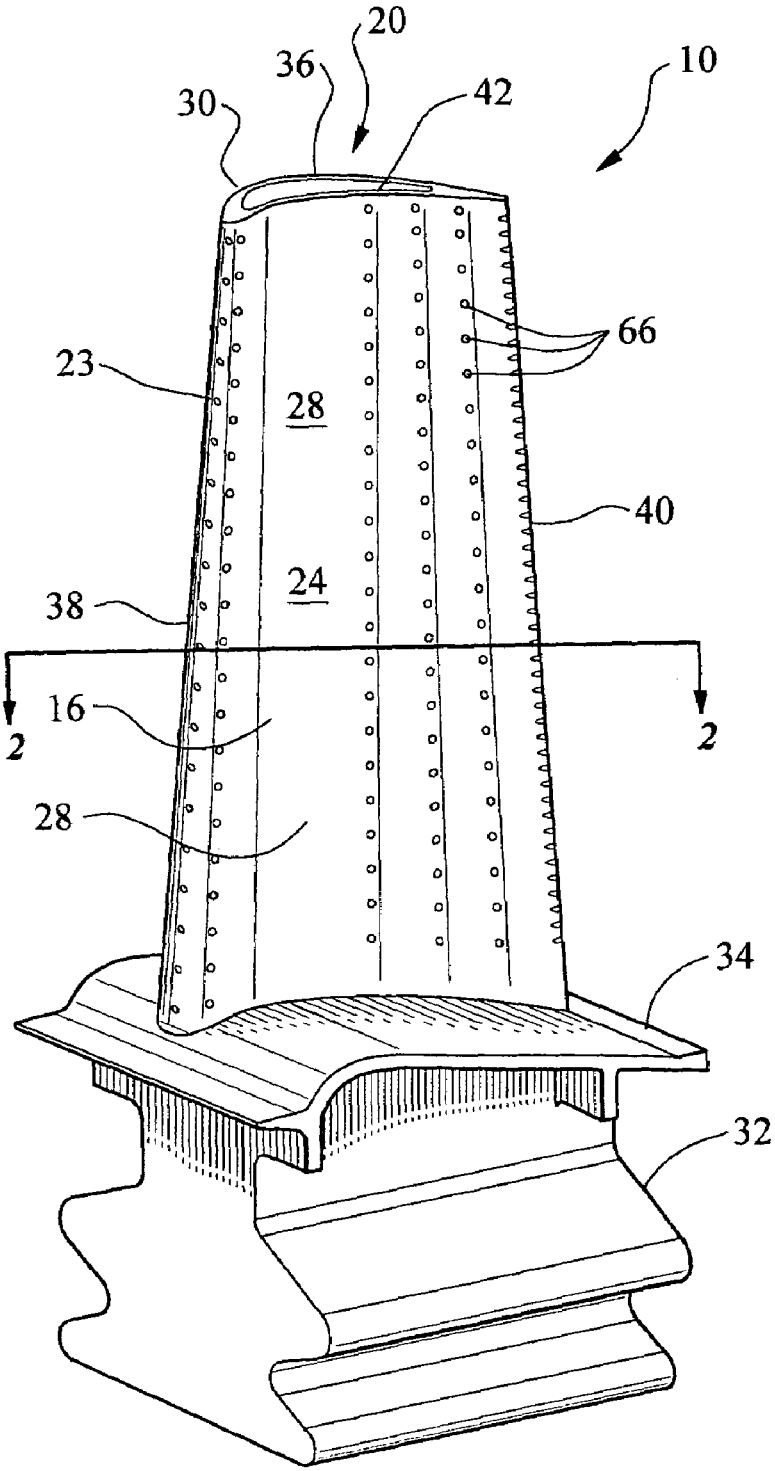
FIG. 1 is a perspective view of a turbine airfoil having features according to the instant invention.
Figure 2:
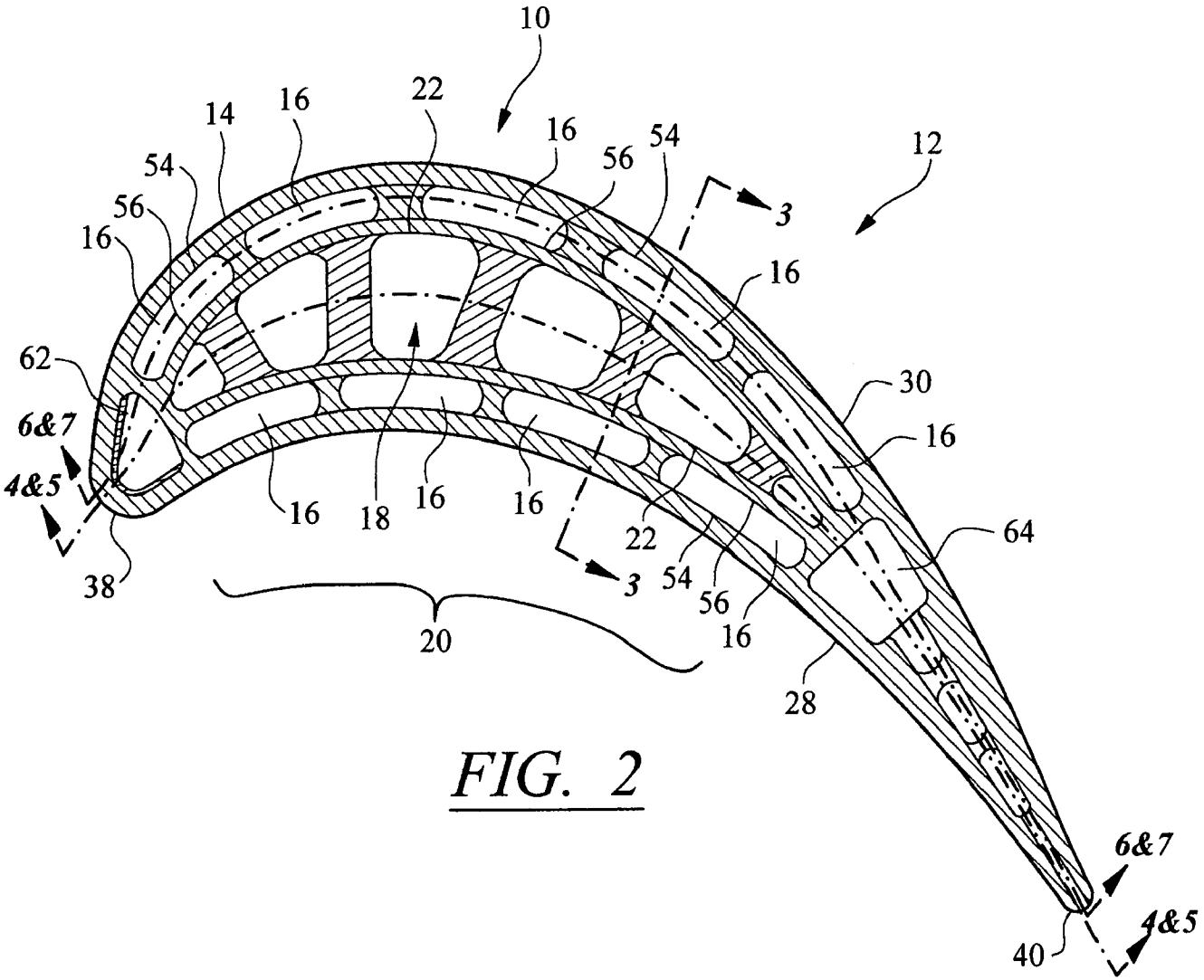
FIG. 2 is a cross-sectional view of the turbine airfoil shown in FIG. 1 taken along section line 2-2.
Figure 3:
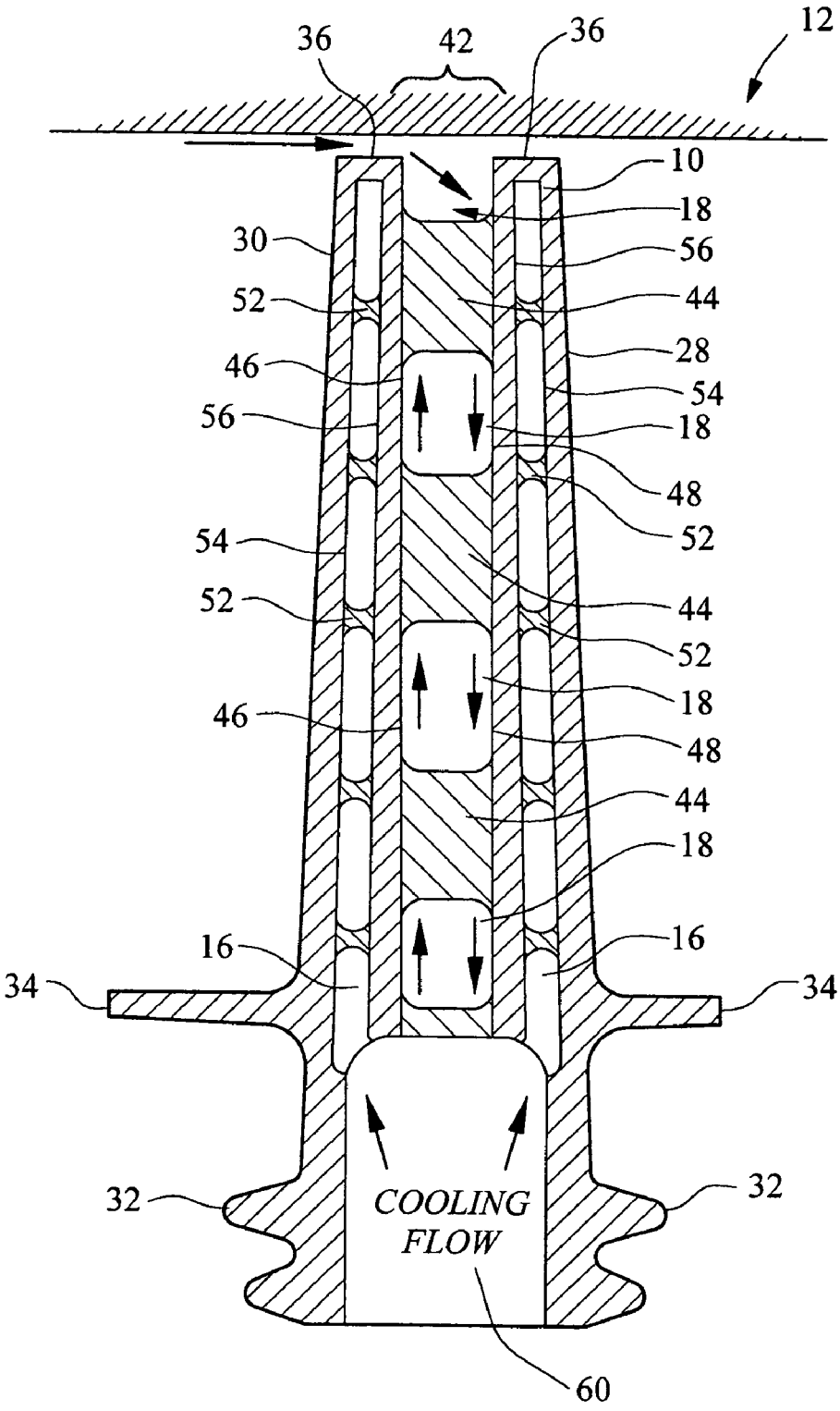
FIG. 3 is a cross-sectional view of the turbine airfoil shown in FIG. 2 taken along section line 3-3.

As shown in FIGS. 1-7, this invention is directed to a turbine airfoil 10 having a cooling system 12 in inner aspects of the turbine airfoil 10 for use in turbine engines. The cooling system 12 may be configured such that adequate cooling occurs within an outer wall 14 of the turbine airfoil 10 by including one or more cavities 16 in the outer wall 14 and configuring each outer cooling cavity 16 based on local external heat loads and airfoil gas side pressure distribution in both chordwise and spanwise directions. The chordwise direction is defined as extending between a leading edge 38 and a trailing edge 40 of the airfoil 10, and the spanwise direction is defined as extending between a tip 36 of the airfoil 10 and a root 32. The turbine airfoil 10 may include a hot gas receiving cavity 18, as shown in FIG. 3, positioned in the mid-chord region 20 of the turbine airfoil 10. The hot gas receiving cavity 18 allows hot combustion gases to flow into central aspects of the turbine airfoil 10 to heat inner walls 22 forming the hot gas receiving cavity 18. By heating the inner walls 22, as shown in FIG. 2, formation of a thermal gradient in the materials forming the outer wall 14 is minimized.

As shown in FIG. 1, the turbine airfoil 10 may be formed from a generally elongated airfoil 23 having an outer surface 24 adapted for use, for example, in an axial flow turbine engine. Outer surface 24 may have a generally concave shaped portion forming pressure side 28 and a generally convex shaped portion forming suction side 30. The generally elongated airfoil 23 may be coupled to a root 32 at a platform 34. The turbine airfoil 10 may be formed from conventional metals or other acceptable materials. The generally elongated airfoil 23 may extend from the root 32 to a tip section 36 and include a leading edge 38 and trailing edge 40. The airfoil 10 may include one or more leading edge cooling channels 62 extending generally spanwise in close proximity to the leading edge 38 of the airfoil 10. The leading edge cooling channel 62 may extend from the root 32 to a position in close proximity to the tip 36 of the airfoil 10. The leading edge cooling channel 62 is not limited to a particular configuration but may have any configuration necessary to cool the leading edge 38 and surrounding areas of the airfoil 10. The airfoil 10 may also include one or more trailing edge cooling channels 64 extending generally spanwise in close proximity to the trailing edge 40 of the airfoil 10. The trailing edge cooling channel 64 may extend from the root 32 to a position in close proximity to the tip 36 of the airfoil 10. The trailing edge cooling channel 64 is not limited to a particular configuration but may have any configuration necessary to cool the trailing edge 40 and surrounding areas of the airfoil 10.

Figure 4:
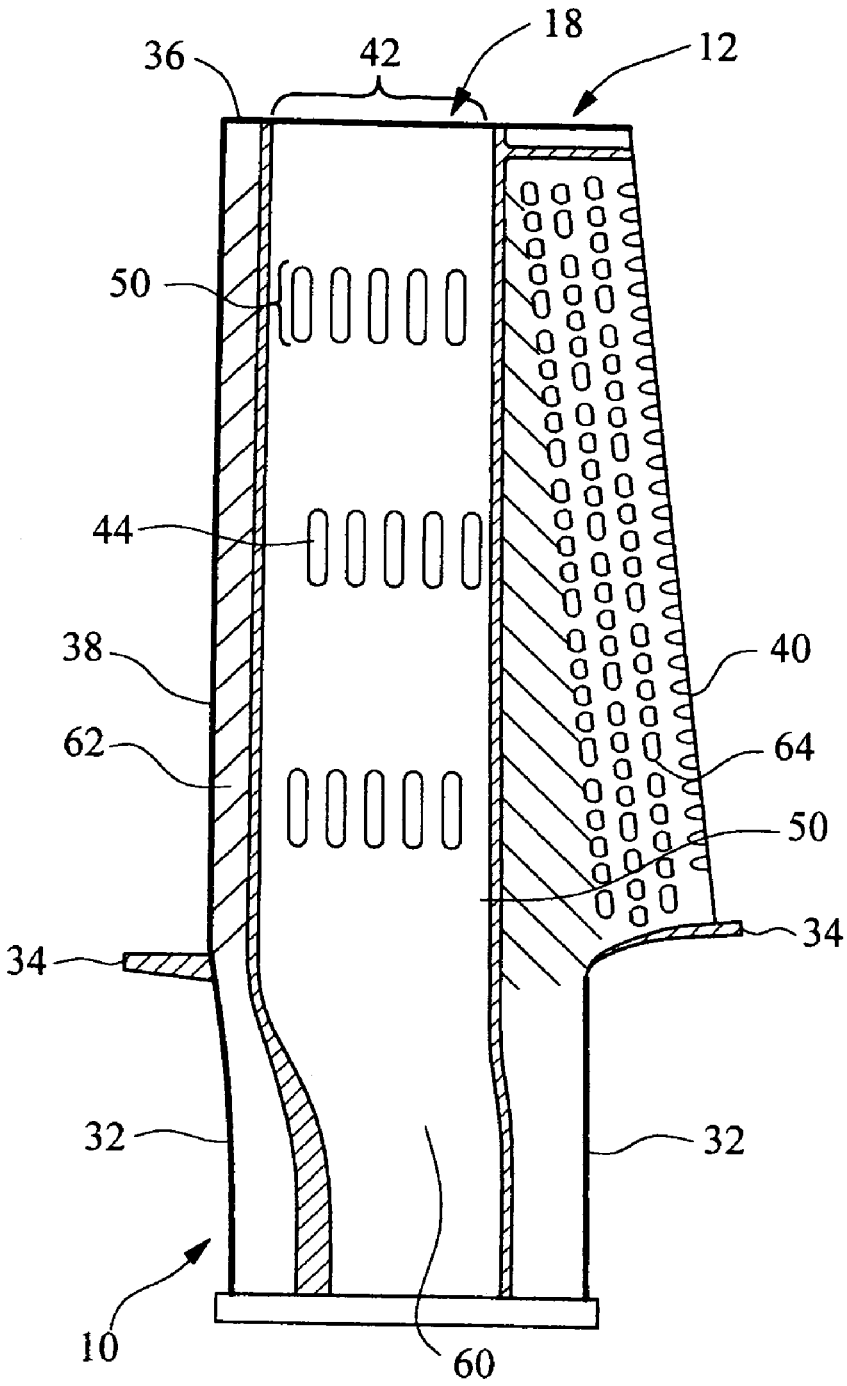
FIG. 4 is a cross-sectional, filleted view of the turbine airfoil shown in FIG. 2 taken along section line 4-4.
Figure 5:
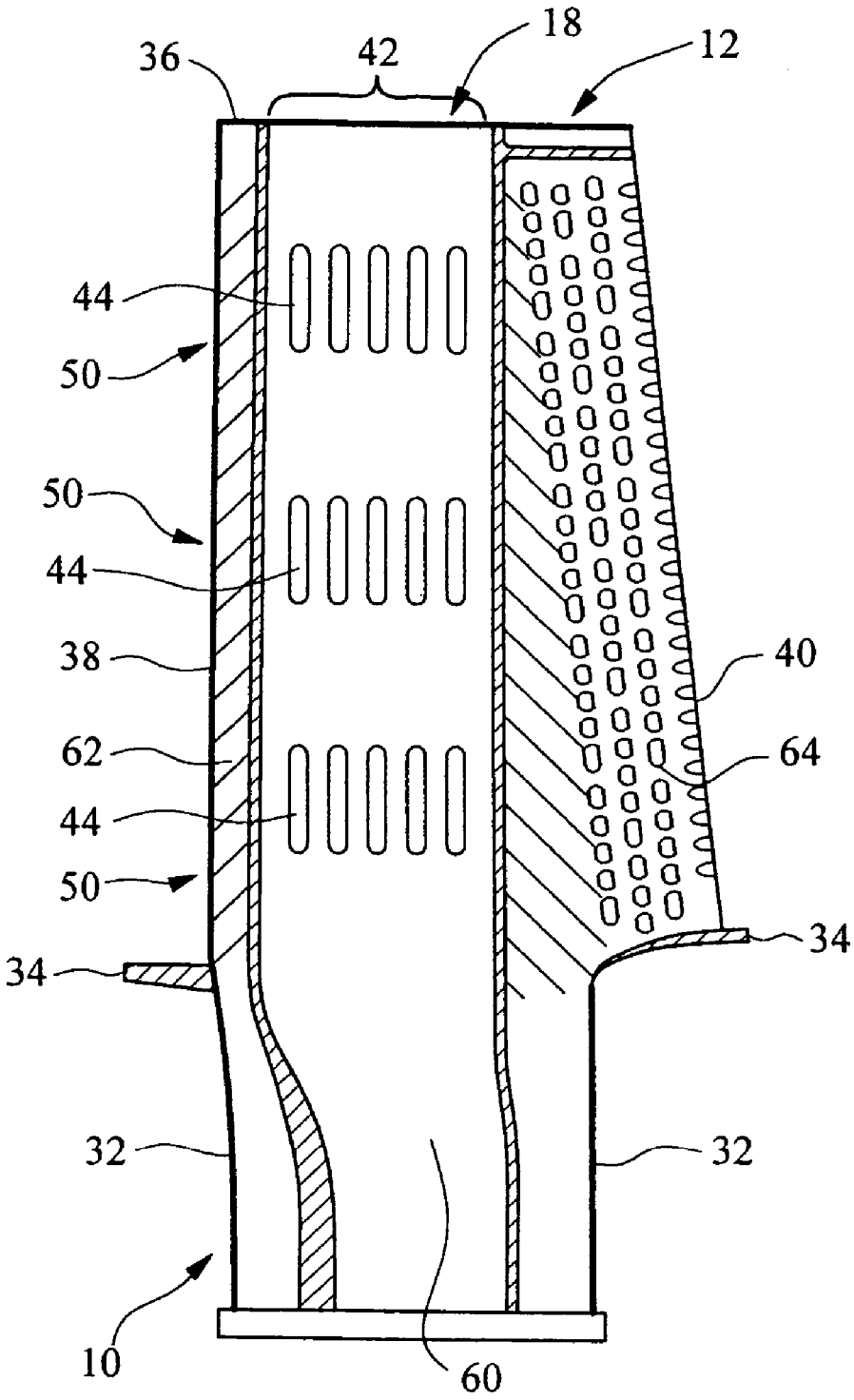
FIG. 5 is a cross-sectional, filleted view of the turbine airfoil shown in FIG. 2 taken along section line 5-5 having an alternative configuration of ribs in the hot gas receiving cavity.

As shown in FIG. 3, the hot gas receiving cavity 18 may have be configured to receive hot gases from the hot gas combustion gases in the turbine engine. The hot gas receiving cavity 18 may receive hot gases through an opening 42 in the tip 36 of the turbine airfoil 10. The hot gas receiving cavity 18 may extend from the opening 42 in the tip 36 toward the root 32 of the airfoil 10. In at least one embodiment, the hot gas receiving cavity 18 may extend from the opening 42 in the tip 36 to a position within close proximity of the root 32. The hot gas receiving cavity 18 may include one or more ribs 44, or pin fins, extending from an inner surface 46 proximate to the suction side 30 to an inner surface 48 proximate to the pressure side 28. The ribs 44 may provide structural support to the airfoil 10 and may provide additional surface area for the passing of heat from the airfoil 10 to the gases surrounding the ribs 44. In at least one embodiment, the airfoil 10 may include a plurality of ribs 44 extending through the cavity 18. As shown in FIGS. 4 and 5, the ribs 44 may be assembled into a plurality of rows 50 that extend chordwise. The ribs 44 may be aligned or offset chordwise from ribs 44 in adjacent rows 50. The ribs 44 may have any appropriate shape or size.

Figure 6:
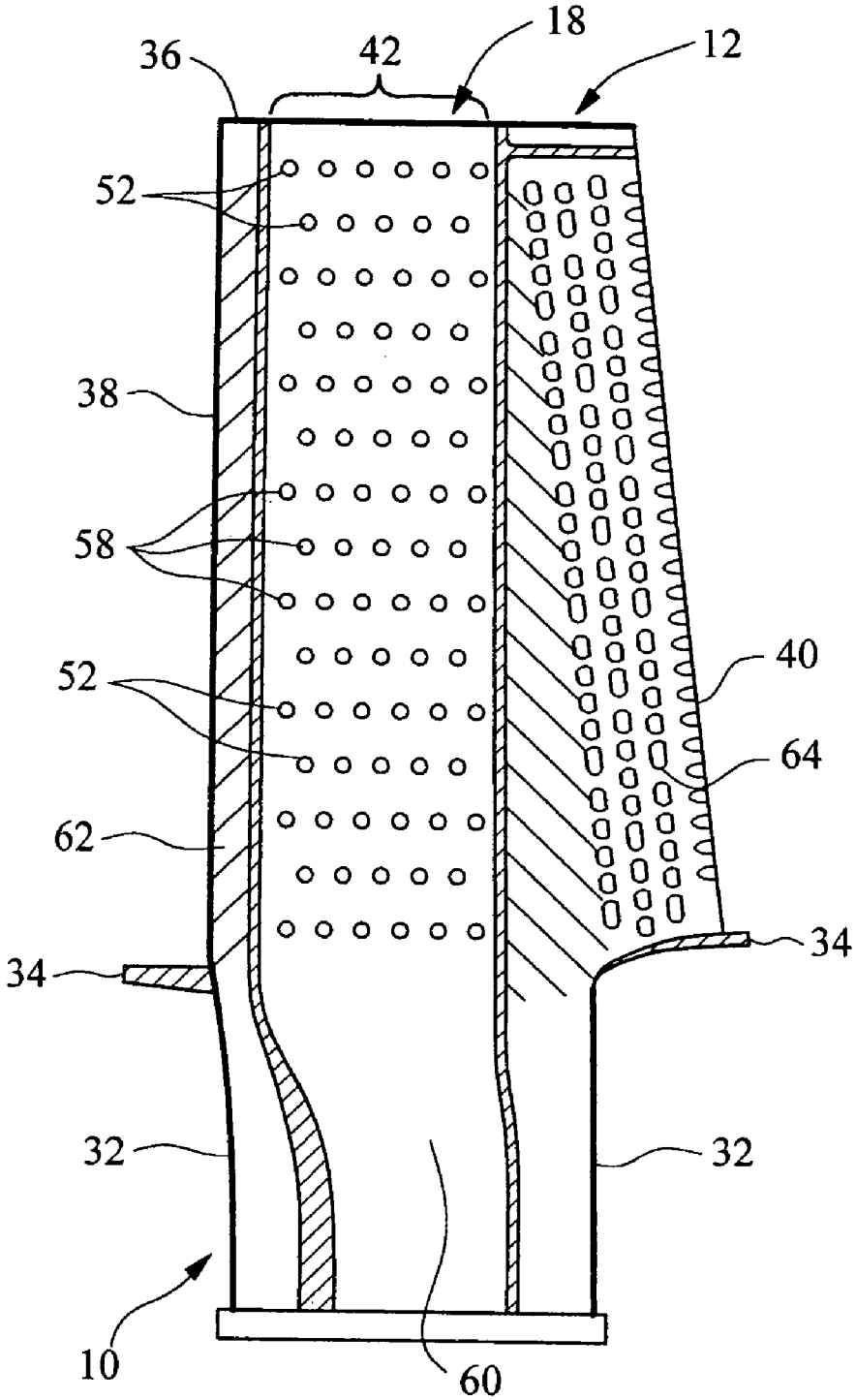
FIG. 6 is a cross-sectional, filleted view of the turbine airfoil shown in FIG. 2 taken along section line 6-6.
Figure 7:
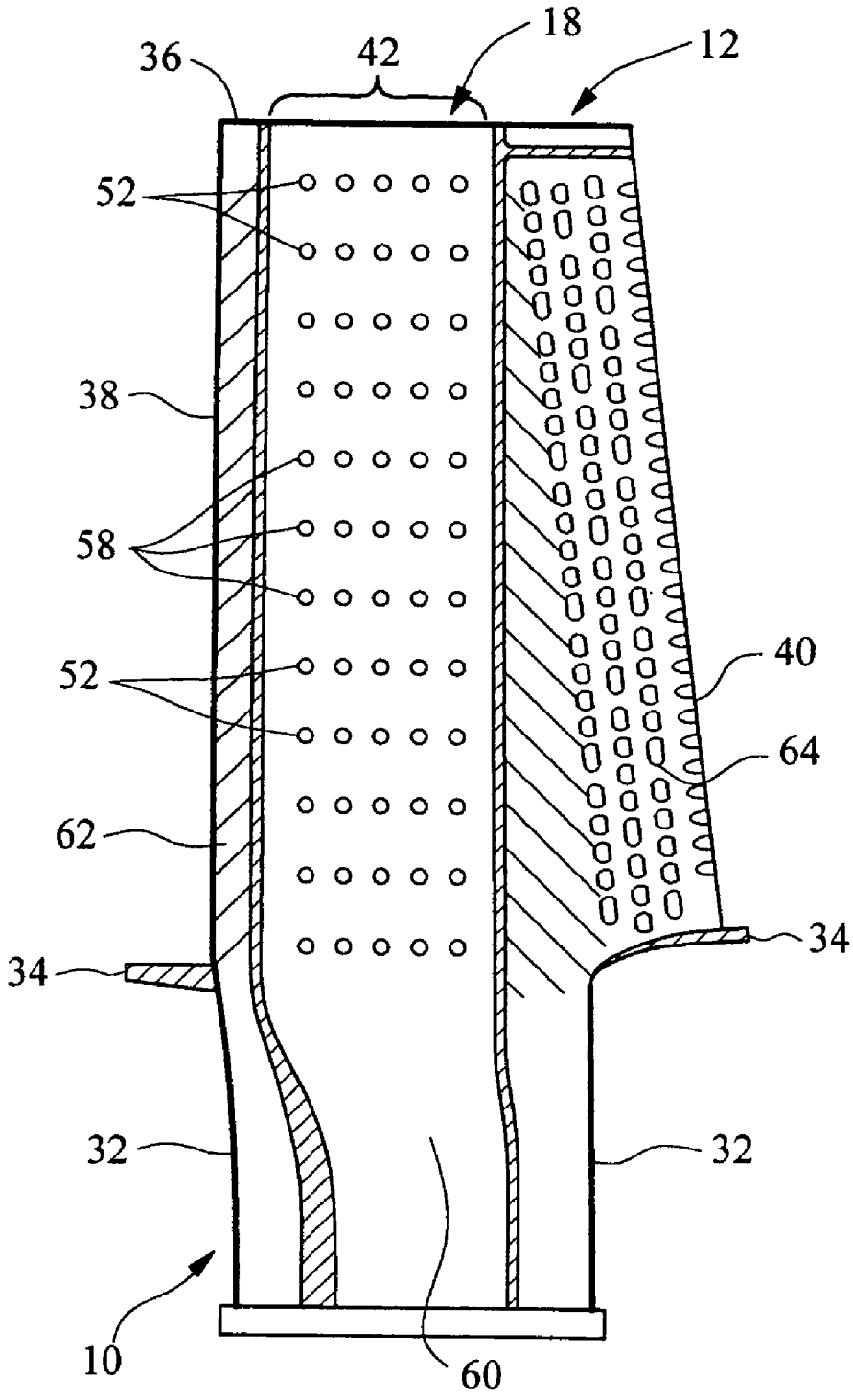
FIG. 7 is a cross-sectional, filleted view of the turbine airfoil shown in FIG. 2 taken along section line 7-7 having an alternative configuration of ribs in the outer cavity.

The outer wall 14 of the airfoil 10, as shown in FIG. 2, may include one or more outer cooling cavities 16 on the pressure side 28 or the suction side 30, or both. Each outer cooling cavity 16 may be in fluid communication with a cooling fluid supply channel 60 in the root 32, as shown in FIG. 3. Each outer cooling cavity 16 may be sized based upon local temperature and pressure profiles, and other appropriate factors. As shown in FIG. 2, the outer cooling cavity 16 may include one or more ribs 52, or pin fins, extending from an inner surface 54 of the outer cooling cavity 16 proximate to an outer surface 24 of the airfoil 10 to an inner surface 56 of the outer cooling cavity 16 proximate to the hot gas receiving cavity 18. In at least one embodiment, the outer cooling cavity 16 may include a plurality of ribs 52. As shown in FIGS. 6 and 7, the plurality of ribs 52 may be aligned into rows 58 extending in the chordwise direction. The chordwise rows 58 may be aligned with or offset from adjacent rows of ribs 52. The ribs 52 may also be offset chordwise from the ribs 44 positioned in the hot gas receiving cavity 18, as shown in FIGS. 2 and 3. The ribs 52 may have any appropriate shape or size.

During use, cooling fluids may be passed through the cooling fluid supply channel 60 in the root 32 and into the outer cavities 16 in the airfoil 10. The cooling fluids may flow through the outer cavities 16 and increase in temperature, thereby decreasing the temperature of the materials forming the airfoil 10. The cooling fluids may flow into contact with the ribs 52 within the outer cavities 16, thereby transferring additional heat from the airfoil 10 to the cooling fluids. The cooling fluids may be exhausted through film cooling orifices 66 in the outer surface 24 of the airfoil 10 and in the tip 36. Hot combustion gases may pass into the hot gas receiving cavity 18 through the opening 42. The hot gases may flow into contact with the ribs 44 in the hot gas receiving cavity 18, thereby enabling heat to be transferred from the hot gases to the ribs 44. Exposing ribs 44 within the hot gas receiving cavity 18 causes heat to be transferred from the hot gases to the ribs 44, thereby maintaining a lower thermal gradient in the materials forming the airfoil than airfoils that have cooling cavities throughout the airfoil.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated airfoil formed from an outer wall, a leading edge, a trailing edge, a pressure side, a suction side, a tip section at a first end, a root coupled to the airfoil at an end generally opposite the first end for supporting the airfoil and for coupling the airfoil to a disc, and at least one cooling cavity in the outer wall forming a cooling system in the airfoil;

wherein the at least one cooling cavity in the outer wall extends generally spanwise from a location proximate to the root to a location proximate to the tip; and at least one hot gas receiving cavity positioned mid-chord in the airfoil, having an opening in the tip, and extending from a location proximate to the root to a location proximate to the tip.

2. The turbine airfoil of claim 1, wherein the at least one hot gas receiving cavity comprises at least one rib extending from an inner surface of the outer wall of the pressure side to an inner surface of the outer wall of the suction side.

3. The turbine airfoil of claim 2, wherein the at least one hot gas receiving cavity comprises a plurality of ribs extending from an inner surface of the outer wall of the pressure side to an inner surface of the outer wall of the suction side.

4. The turbine airfoil of claim 3, wherein the plurality of ribs form a plurality of rows extending in a chordwise direction, wherein the ribs of adjacent rows are aligned chordwise.

5. The turbine airfoil of claim 3, wherein the plurality of ribs form a plurality of rows extending in a chordwise direction, wherein the ribs of adjacent spanwise rows are offset chordwise.

6. The turbine airfoil of claim 1, wherein the at least one cooling cavity in the outer wall comprises at least one rib extending from a first inner surface forming the at least one cooling cavity and proximate to an outer surface of the airfoil to a second inner surface forming the at least one cooling cavity, opposite to the first inner surface, and proximate to a surface of the airfoil forming the hot gas receiving cavity.

7. The turbine airfoil of claim 6, wherein the at least one cooling cavity in the outer wall comprises a plurality of ribs extending from a first inner surface forming the at least one cooling cavity and proximate to an outer surface of the airfoil to a second inner surface forming the at least one cooling cavity, opposite to the first inner surface, and proximate to a surface of the airfoil forming the hot gas receiving cavity.

8. The turbine airfoil of claim 7, wherein the plurality of ribs are offset chordwise from the plurality of ribs in the at least one hot gas receiving cavity.

9. The turbine airfoil of claim 7, wherein the plurality of ribs in the outer wall form a plurality of rows extending in a chordwise direction in which the ribs are aligned in the chordwise direction with adjacent ribs.

10. The turbine airfoil of claim 7, wherein the plurality of ribs in the outer wall form a plurality of rows extending in a chordwise direction in which the ribs are offset in the chordwise direction with adjacent ribs.

11. The turbine airfoil of claim 1, further comprising at least one leading edge spanwise cooling channel extending from generally proximate the root toward the tip.

12. The turbine airfoil of claim 1, further comprising at least one trailing edge spanwise cooling channel extending from generally proximate the root toward the tip.

13. The turbine airfoil of claim 1, further comprising at least one leading edge spanwise cooling channel extending from generally proximate the root toward the tip and at least one trailing edge spanwise cooling channel extending from generally proximate the root toward the tip.

14. A turbine airfoil, comprising:

a generally elongated airfoil formed from an outer wall, a leading edge, a trailing edge, a pressure side, a suction side, a tip section at a first end, a root coupled to the airfoil at an end generally opposite the first end for supporting the airfoil and for coupling the airfoil to a disc, and at least one cooling cavity in the outer wall forming a cooling system in the airfoil;

wherein the at least one cooling cavity in the outer wall extends generally spanwise from a location proximate to the root to a location proximate to the tip; and at least one hot gas receiving cavity positioned mid-chord in the airfoil, having an opening in the tip, and extending from a location proximate to the root to a location proximate to the tip; and wherein the at least one hot gas receiving cavity includes a plurality of ribs extending from an inner surface of the outer wall of the pressure side to an inner surface of the outer wall of the suction side.

15. The turbine airfoil of claim 14, wherein the plurality of ribs form a plurality of rows extending in a chordwise direction, and the ribs of adjacent rows are aligned in the chordwise direction.

16. The turbine airfoil of claim 14, wherein the plurality of ribs form a plurality of rows extending in a chordwise direction, and the ribs of adjacent rows are offset in the chordwise direction.

17. The turbine airfoil of claim 14, wherein the at least one cooling cavity in the outer wall comprises a plurality of ribs extending from a first inner surface forming the at least one cooling cavity and proximate to an outer surface of the airfoil to a second inner surface forming the at least one outer cavity, opposite to the first inner surface, and proximate to a surface of the airfoil forming the hot gas receiving cavity.

18. The turbine airfoil of claim 17, wherein the plurality of ribs in the at least one cooling cavity in the outer wall are offset chordwise from the plurality of ribs in the at least one hot gas receiving cavity.

19. The turbine airfoil of claim 17, wherein the plurality of ribs in the outer wall form a plurality of rows in which the ribs are aligned chordwise with adjacent ribs.

20. The turbine airfoil of claim 17, wherein the plurality of ribs in the outer wall form a plurality of rows in which the ribs are offset chordwise relative to adjacent ribs.

* * * * *